US005203501A

United States Patent [19]

Vanotti

[11] Patent Number: 5,203,501

[45] Date of Patent: Apr. 20, 1993

[54] DEVICE FOR FIXING A RAIL ONTO A SLAB OF CONCRETE

[75] Inventor: Gerard Vanotti, St-Paul De Varax, France

[73] Assignee: Etablissements Vape, Saint-Martin-Du-Fresne, France

[21] Appl. No.: 823,675

[22] Filed: Jan. 21, 1992

[30] Foreign Application Priority Data

Feb. 4, 1991 [FR] France ..... 01220

[51] Int. Cl.[5] ..... E01B 9/38; E01B 9/68; E01B 19/00

[52] U.S. Cl. ..... 238/265; 238/282; 238/284; 238/349; 238/382

[58] Field of Search ..... 238/265, 282, 283, 284, 238/349, 351, 382

[56] References Cited

U.S. PATENT DOCUMENTS

| | | | |
|---|---|---|---|
| 1,435,074 | 11/1922 | Lott | 238/265 |
| 1,971,927 | 8/1934 | Willard | 238/349 |
| 2,009,309 | 7/1935 | Davies et al. | 238/349 |
| 4,405,081 | 9/1983 | Tack | 238/282 |
| 4,618,093 | 10/1986 | Young et al. | 238/351 |
| 4,705,215 | 11/1987 | Eisenberg et al. | 238/349 |
| 4,771,944 | 9/1988 | Brister et al. | 238/283 |
| 4,907,740 | 4/1990 | Oberweiler et al. | 238/283 |
| 4,927,078 | 5/1990 | Vanotti | 238/349 |
| 5,042,717 | 8/1991 | Vanotti | 238/349 |
| 5,096,119 | 5/1992 | Schultheiss et al. | 238/349 |

*Primary Examiner*—Michael S. Huppert
*Assistant Examiner*—Stephen T. Gordon
*Attorney, Agent, or Firm*—Kane, Dalsimer, Sullivan, Kurucz, Levy, Eisele and Richard

[57] ABSTRACT

Device for fixing a rail onto a slab of concrete comprising a metal chair fixed onto a metal base with interposition of a resilient sole, by means of clamps which are tightened by rotation on an inclined plane and which come to fix simultaneously the rail onto the metal chair and the metal chair onto the base. Preferably the clamps press against pillars formed on the base.

3 Claims, 2 Drawing Sheets

DEVICE FOR FIXING A RAIL ONTO A SLAB OF CONCRETE

FIELD OF THE INVENTION

The subject of the present invention is a device for fixing a rail onto a slab of concrete without ballast comprising a metal chair presenting a facing intended to receive the rail and resting on a resilient sole itself resting on a metal base resting on the concrete, with possible interposition of an insulating sole, means for fixing the base onto the concrete, means for fixing the metal chair onto the base and means for fixing the rail onto the chair.

The laying of track without ballast, on a raft or slabs of concrete, is a technique which tends to be necessary on bridges and viaducts and in tunnels as it allows the total height of the track to be greatly reduced, this reduction resulting in major savings which broadly compensate for the additional costs incurred in using such a technique. For bridges and viaducts, the laying of track without ballast is often the only solution enabling the requirements to be respected regarding the longitudinal profile of the track and the road, river or railroad loading gage to be left clear under the construction. In tunnels, such a technique, while reducing maintenance work, improves safety.

PRIOR ART

In the S.N.C.F. publication "LES POSES DE VOIE SANS BALLAST" ("TRACK LAYING WITHOUT BALLAST"), by M R SAUVAGE and M J ERIEAU, a device as defined above is described, under the name type D device termed "Monaco device", wherein the means for fixing the metal chair onto the base are constituted by tie clips fixed by means of special hooked bolts coming to fasten into a recess of the base, whereas the means for fixing the rail onto the metal chair are also constituted by rigid tie clips gripped by means of bolts the head of each of which comes to bear, by rotation through a quarter turn, in a recess made in the lower face of the chair, and by resilient washers.

In this same publication are described devices without metal bases, wherein the resilient sole rests directly on the concrete. These devices however have a greater lateral flexibility than the "Monaco" device and are therefore reserved for straights and curves of large radius, greater than 500 m.

The present invention aims to simplify the known devices of the metal base and chair type while retaining, or even improving, the resilient characteristics of the fixing device, particularly the track dynamic modulus.

SUMMARY OF THE INVENTION

The fixing device according to the invention is defined in that the means for fixing the chair onto the base and the means for fixing the rail onto the chair are common and are constituted by clamps, known per se, constituted by a rod having a vertical rectilinear part provided with a heel coming to fasten into the base and an undulating curved part forming a spring, the end of which comes to grip the flange of the rail after having been tightened, by rotation, on a ramp of the chair, and presenting an intermediate bearing point substantially opposite the end pressing onto the flange of the rail.

Such a clamp is described in Patent EP-0,373,099 of the Applicant. These clamps are moreover marketed under the registered trade mark SYRESCA.

Two clamps are thus sufficient in order to fix the metal chair onto the base and the rail onto the metal chair, whereas in the prior device sixteen elements are necessary, not to mention the additional resilient washers.

According to a preferred embodiment of the invention, the intermediate bearing point of each fixing clamp presses onto a pillar integral with the base and passing through the resilient sole and the metal chair, in such a manner that the intermediate bearing point of the clamp is not subjected to the vertical displacements of the chair due to vertical vibrations when a train passes, which displacements would tend to separate the intermediate bearing point from the chair if the clamp were pressing onto the chair.

According to a preferred embodiment of the invention the resilient sole is alveolate on both of its faces, the alveoli being arranged in such a manner that the resilient sole has in the middle part of its thickness a continuity transversely to the rail, except in the places through which the pillars of the base pass, so as to ensure effective damping in the vertical plane while offering high resistance to horizontal shearing stresses.

BRIEF DESCRIPTION OF THE DRAWINGS

An embodiment of the device according to the invention will now be described with reference to the attached drawing, in which.

DESCRIPTION OF THE PREFERRED EMBODIMENT

Figure 1:
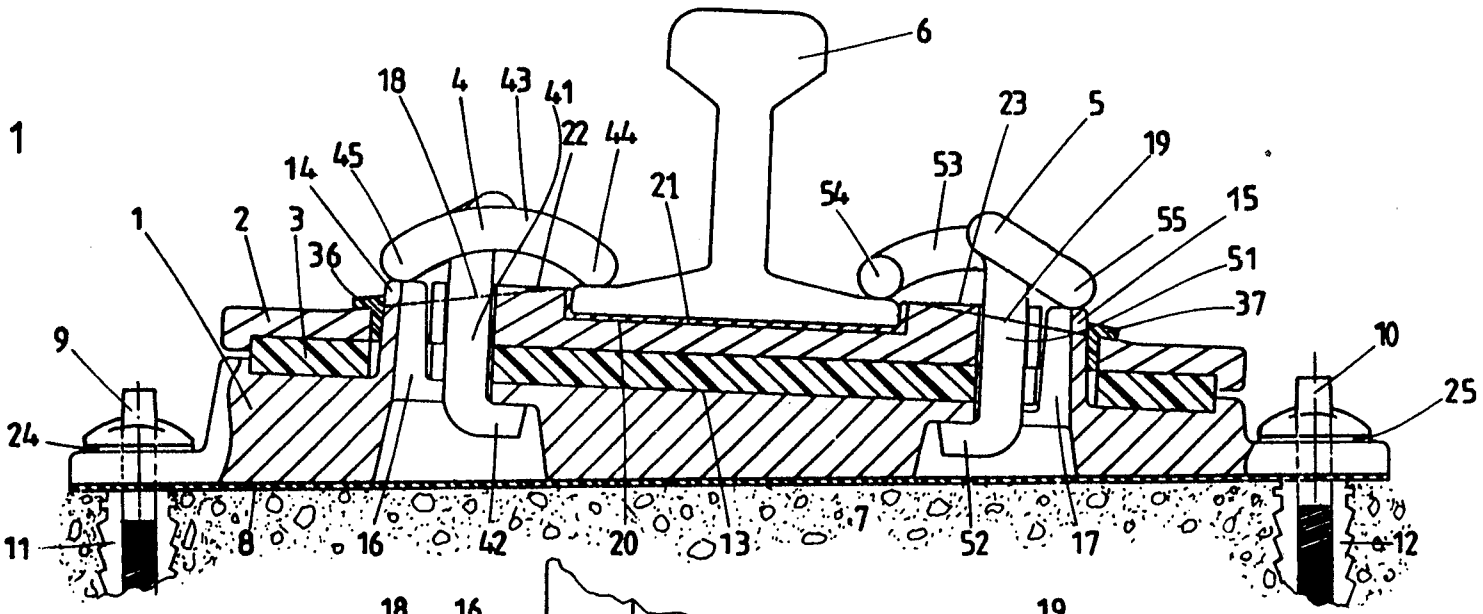
FIG. 1 gives a longitudinal sectional view of the device along line I—I of FIG. 2.
Figure 2:
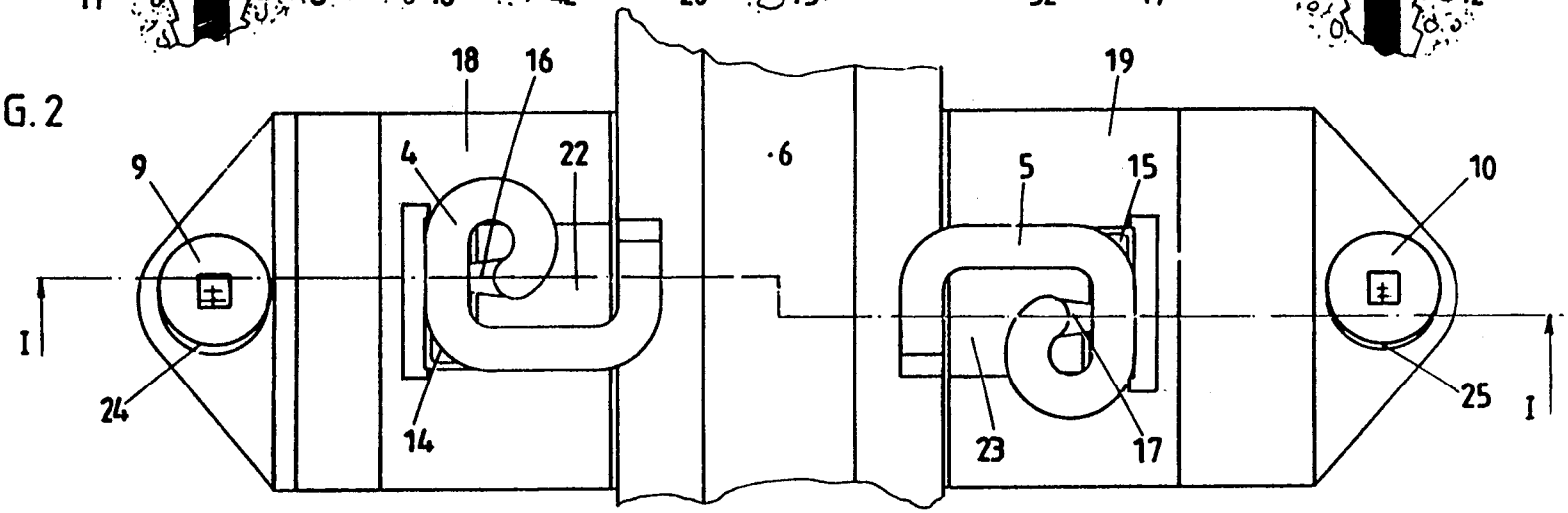
FIG. 2 gives a plan view of the device.

The device shown in FIGS. 1 and 2 comprises essentially a metal base 1 of rectangular shape, a metal chair 2 an intermediate sole 3 made of rubber and two clamps 4 and 5 holding simultaneously a rail 6 on the chair 2 and this chair on the base 1.

The base 1 is fixed onto a slab of concrete 7, with interposition of an insulating sole 8, by means of two long bolts 9 and 10 screwed into sleeves 11 and 12 buried in the concrete. The long bolts 9 and 10 and the sleeves 11 and 12 form the PLASTIRAIL (registered trade mark) process as described in Patent FR-2,636,685.

The upper face of the base 1 presents a transversely inclined facing 13, the device shown being intended to fix a rail in a curve. The resilient sole 3 is retained laterally by the edges of this facing.

The clamps 4 and 5 are SYRESCA (registered trade mark) clamps as described in Patent EP-0,373,099. The clamp 4 has a rectilinear part 41, a heel 42 at its lower end, an upper part 43 in the form of an undulating spring the end 44 of which presses onto the heel of the rail 6 and a low intermediate point 45 of which presses onto a column 14 of the base 1, this column passing through the resilient sole 3 and the chair 2. The clamp 5 is identical to the clamp 4, the corresponding parts being designated by 51 through 55. The intermediate bearing point 55 presses onto a second column 15 of the base 1. This base 1 has oblong holes 16 and 17 for the heels 42 and 52 of the clamps to pass through when they are fitted.

The metal chair 2 has two ramps 18 and 19 extending respectively on either side of the columns 14 and 15 and the upper end of which is at the level of the flange of the rail 6. These ramps serve to tighten the clamps as described in Patent EP-0,373,099. The metal chair 2 additionally has two platforms 22 and 23 parallel with the base of the chair, at the same level as the columns 14 and 15 and serving as support for the intermediate bearing points 45 and 55 during the rotation of the clamps 4 and 5. The chair 2 also presents a facing 20 in which is housed the flange of the rail with interposition of a sole 21 made of synthetic material rising on either side of the flange of the rail.

Eccentric-type adjustment washers 24 and 25 enable the position of the base 1 to be adjusted o the slab of concrete. As a variant, two pairs of oblong holes could be provided.

The clamps 4 and 5 are fitted as described in Patent EP-0,373,099, that is to say in a position turned through 180° with respect to the position shown. They are then turned slightly so as to fasten their heels into the base with a certain tension due to the rising of the ends 44 and 54 of the clamps on the ramps 18 and 19 and due to the compression of the resilient sole 3. An assembly is thus obtained consisting of the base 1, of the resilient sole 3, of the chair 2 and of the clamps 4 and 5, which assembly can be handled and transported like a monobloc element. After its fixing onto the slab of concrete by means of the long bolts 9 and 10, the rail 6 is put into place and fixed by rotation of the clamps 4 and 5.

Once the rail has been laid, a transverse adjustment accurate to a millimeter is possible by means of adjustment shims 36 and 37 made of plastic material.

Figure 4:
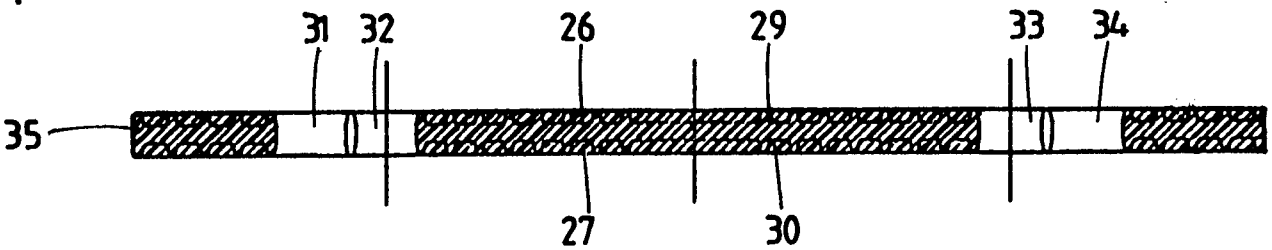
FIG. 4 is a sectional view along line IV—IV of FIG. 3.
Figure 3:
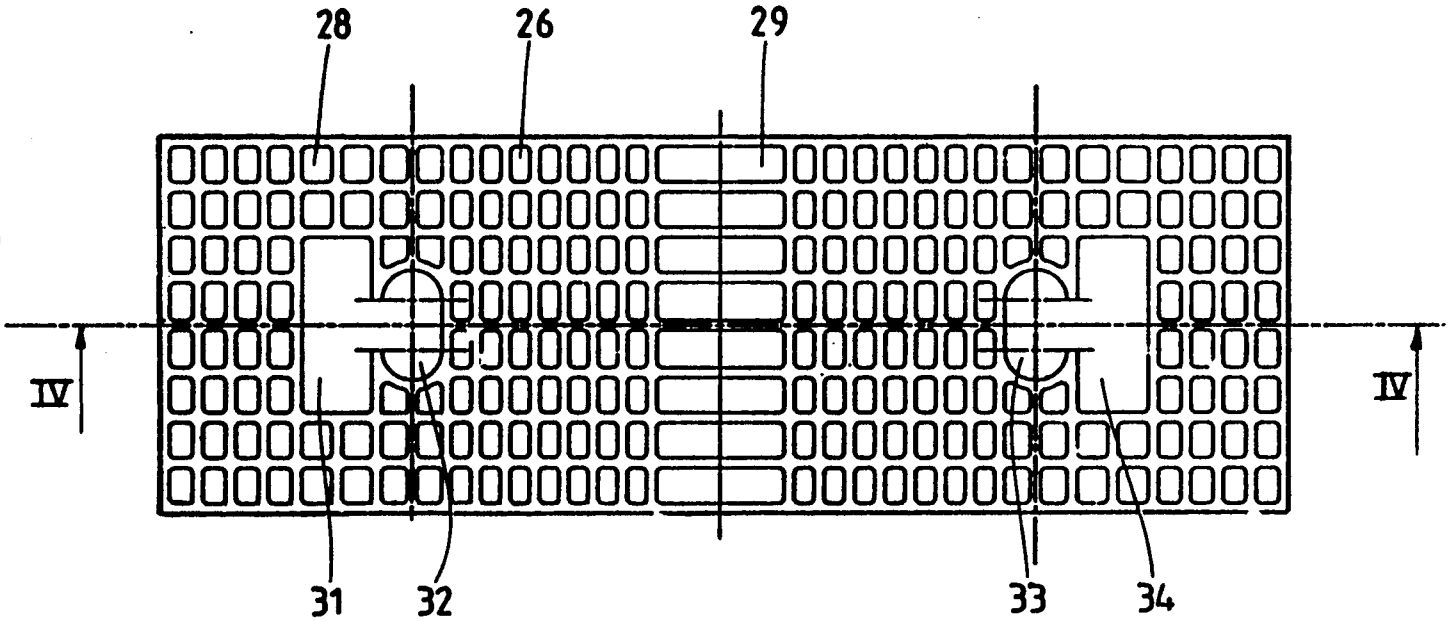
FIG. 3 gives a plan view of another embodiment of the resilient sole.

The resilient sole 3 may have different structures. An advantageous structure is shown in FIGS. 3 and 4. The sole shown is alveolate, that is to say that it has on both of its faces alveoli or cavities which are substantially rectangular and of three different sizes 26/27, 28, 29/30. The alveoli 29 and 30 are elongate in a direction transverse to the rail. The sole has cutouts 31, 32, 33, 34 for the columns 14 and 15 and the clamps to pass through. The sole therefore has a continuous web 35 except at the places of the cutouts. This web ensures that the sole is highly resistent to the shearing stresses exerted parallel with the sole, whereas the alveoli of these two faces provide good damping of vibrations in the vertical direction. This conforms to the requirements.

The upper face of the base 1 will of course be flat or of a different inclination depending on whether the device is intended to fix the rails in a rectilinear part or in a curve of different radius.

I claim:

1. A device for fixing a rail having a rail flange onto a slab of concrete (7) without ballast, said device comprising;

a metal base (1) resting on said slab of concrete and having pillars (14, 15) integral with said metal base;

a resilient sole (3) resting on said metal base (1);

a metal chair (2) presenting a facing arranged and constructed to receive said rail (6) and resting on said resilient sole (3), with said pillars (14, 15) passing through said resilient sole (3) and said metal chair (2);

base fixing means (9, 10) for fixing said metal base (1) to said concrete slab (7);

chair and rail fixing means for fixing said metal chair (2) to said metal base (1) and for fixing said rail to said metal chair (2), said chair and rail fixing means including clamps (4, 5);

each said clamp having a rod with a vertical rectilinear part, a heel attached to said rectilinear part and engaging said metal base (1) and an undulating curved part attached to the vertical rectilinear part, said curved part forming a spring with spring end, said spring end being arranged to grip said rail flange;

said undulating curved part having an intermediate bearing point (45, 55) substantially opposite to said spring end and bearing on one of said pillars.

2. The fixing device as claimed in claim 1, wherein the resilient sole is alveolate on both of its faces, the alveoli (26 through 30) being arranged in such a manner that the resilient sole has in the middle part of its thickness a continuity transverse to the fail, except in the places through which pass the pillars of the base onto which press the fixing clamps.

3. The fixing device as claimed in claim 1, which comprises adjustment shims (36, 37) made of plastic material intended to be inserted between the metal chair (2) and said pillars (14, 15) after laying of the rail.

* * * * *